United States Patent [19]

Lotz et al.

[11] Patent Number: 4,718,400

[45] Date of Patent: Jan. 12, 1988

[54] GAS RANGE CONSTRUCTION

[75] Inventors: Lawrence C. Lotz; Franklin D. Garrison, both of Marion, Ohio

[73] Assignee: Whirlpool Corporation, Benton Harbor, Mich.

[21] Appl. No.: 945,900

[22] Filed: Dec. 24, 1986

[51] Int. Cl.[4] ..... F24C 15/00; F24C 3/00

[52] U.S. Cl. ..... 126/41 R; 126/19 R; 126/39 B

[58] Field of Search ..... 126/14, 21 R, 39 R, 126/39 B, 39 C, 39 D, 19 R, 41 R, 273 R; 99/340, 385

[56] References Cited

U.S. PATENT DOCUMENTS

| | | | |
|---|---|---|---|
| 2,463,712 | 3/1949 | Newell . | |
| 2,480,045 | 8/1949 | Reeves | 126/19 |
| 2,625,928 | 1/1953 | Gould | 126/39 R |
| 2,746,448 | 5/1956 | Holmsten | 126/19 |
| 2,843,104 | 7/1958 | Brosene, Jr. et al. | 126/41 |
| 2,883,978 | 4/1959 | Nelson et al. | 126/21 |
| 3,063,441 | 11/1962 | Stoligrosz | 126/21 |
| 3,090,371 | 5/1963 | Davis | 126/21 |
| 3,096,753 | 7/1963 | Freund et al. . | |
| 3,122,134 | 2/1964 | Reeves | 126/41 |
| 3,150,655 | 9/1964 | Saponara | 126/21 |
| 3,151,610 | 10/1964 | Hanson et al. . | |
| 3,347,609 | 10/1967 | Mann | 312/263 |
| 3,357,475 | 12/1967 | Schweitzer | 126/41 |
| 3,363,088 | 1/1968 | Keppler | 219/392 |
| 3,480,000 | 11/1969 | Torrey et al. | 126/41 |
| 3,624,742 | 11/1971 | Hurko | 126/41 |
| 4,025,299 | 5/1977 | Dubois | 432/129 |
| 4,250,865 | 2/1981 | Scherer | 126/41 D |
| 4,598,691 | 7/1986 | Herrelko et al. | 126/41 R |

*Primary Examiner*—Margaret A. Focarino
*Attorney, Agent, or Firm*—Wood, Dalton, Phillips, Mason & Rowe

[57] ABSTRACT

According to the invention, a universal frame is provided for use in both high and low broiler configuration gas ranges. The range frame has a housing with an internal wall surface defining a cooking space. A gas burner is mounted in the cooking space between a main oven compartment and a broiling compartment in the low broiler configuration. Structure is provided to selectively mount a wall within the cooking space to shield the lower compartment from the heating element. The lower compartment can thereby be adapted for use as a storage compartment in a high broiler configuration. With the wall omitted, the heating element is directly exposed to the bottom compartment for broiling therein.

14 Claims, 6 Drawing Figures

FIG. 1
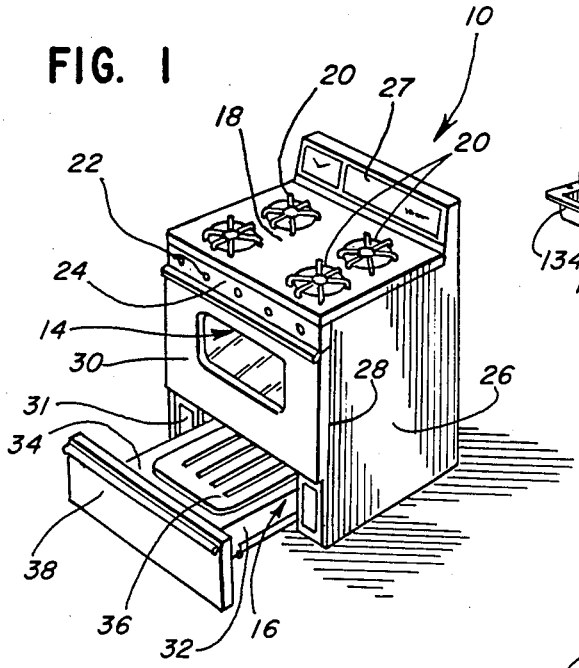
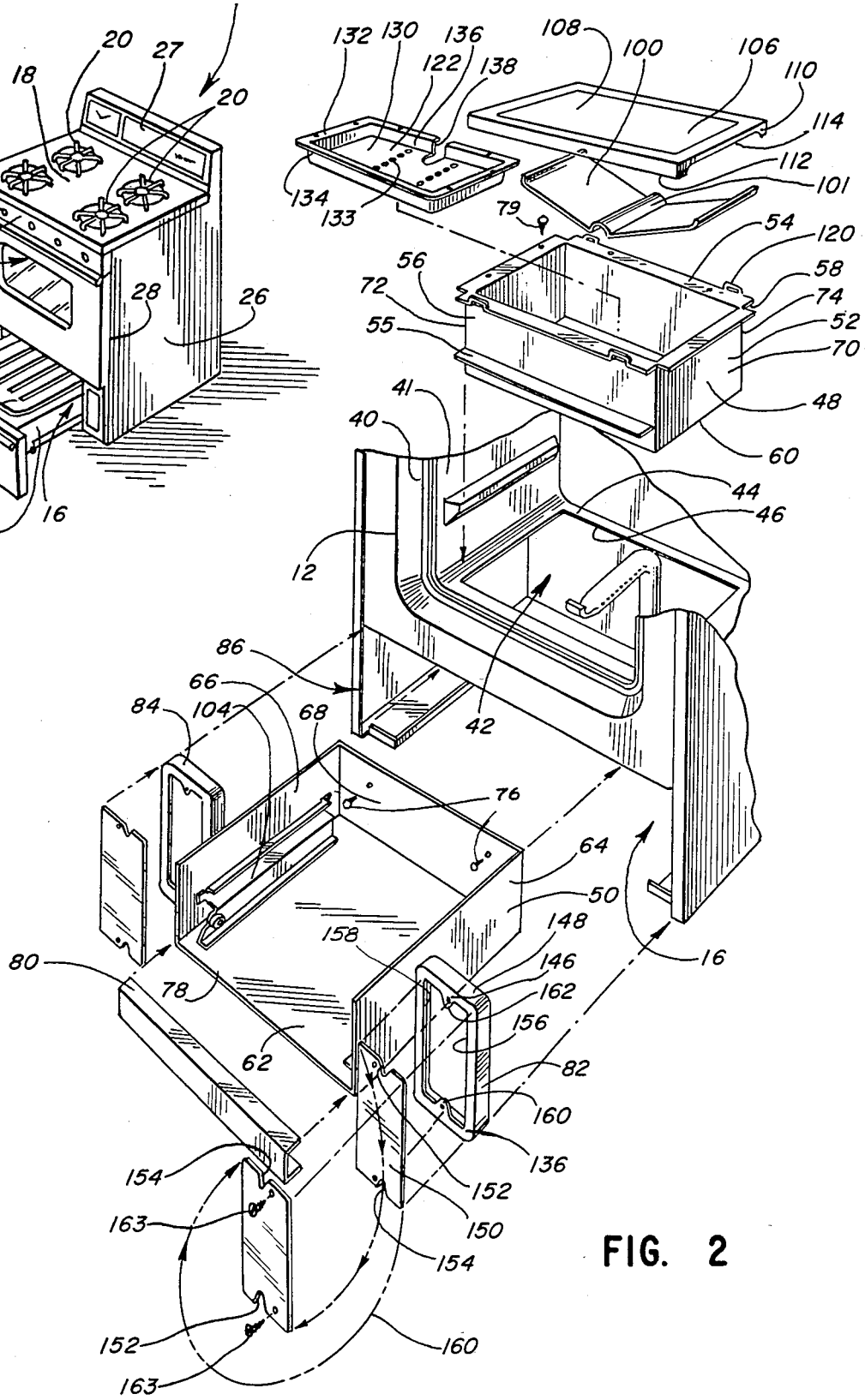
FIG. 2

GAS RANGE CONSTRUCTION

BACKGROUND OF THE INVENTION

1. Field of the Invention

This invention relates to cooking ranges and, more particularly, to a universal frame that can be used selectively in gas cooking ranges in both high broiler and low broiler configurations.

2. Background Art

Free standing gas ranges can generally be classified in two different categories—high broiler and low broiler configurations. The high broiler configuration is advantageous to provide the range with a self-cleaning oven. Each configuration has two separate, internal compartments.

In the high broiler configuration, separate upper and lower gas burners are provided in the main oven compartment which is typical of self-cleaning ovens. The upper burner is used for broiling and the lower burner is used for baking in the main compartment. A dividing wall shields a compartment defined below the main oven compartment from the lower burner to permit the lower compartment to be used as for the storage of cooking utensils and the like.

In the low broiler configuration, a single burner is used both for baking in the main compartment and broiling in the lower compartment. Food is delivered into and removed from the bottom compartment typically on a sliding drawer. With the lower broiler configuration, the walls of the lower compartment and the surface on which the range is supported must be protected to withstand heat from the exposed burner flame.

Heretofore, ranges have been specifically, manufactured as either high or low broiler types. Manufacturers have dealt with the inconvenience of having to separately manufacture and inventory two different range configurations. As a result, manufacturing costs are increased substantially over what they would be with a single model range.

SUMMARY OF THE INVENTION

The present invention is specifically directed to overcoming the above enumerated problems in a novel and simple manner.

According to the invention a universal frame is provided for use in both high and low broiler configuration ranges. The range frame has a housing with an internal wall surface defining a cooking space. A gas burner is mounted in the cooking space between a main oven compartment and a broiling compartment in the low broiler configuration.

According to the invention, structure is provided to selectively mount a wall within the cooking space to shield the lower compartment from the gas burner. The lower compartment can thereby be adapted for use as a storage compartment in a high broiler configuration. With the shield wall omitted, the gas burner is directly exposed to the bottom compartment for broiling therein.

The advantage of the above structure to a manufacturer is that only one style frame need be constructed and inventoried. Depending upon demand, a manufacturer can convert the frame selectively to either the high or low broiler configuration. The number of frames kept on hand can thus be reduced. Further, a manufacturer requires tooling only for one type of frame configuration, which further reduces costs.

Preferably, a divided wall with an opening therethrough is provided between the main oven compartment and the lower, broiling/storage compartment. In the high broiler configuration, a pan is mounted on the dividing wall and has a wall disposed beneath the gas burner to shield the lower compartment from the gas burner.

In a low broiler configuration, the pan in the high broiler configuration is omitted and a gas burner shield structure is disposed in the bottom compartment to protect the frame and range support surface from heat given off by the gas burner. The gas burner shield structure comprises a collar that is directed through the opening in the dividing wall. The collar has an outturned flange which is used for connection to the dividing wall and a depending skirt which supports a separate, lower portion of the shield structure. The collar and lower portion of the shield structure cooperatively bound a space which serves as a broiling chamber.

In a gas range, the invention contemplates that a control valve for the burner be situated within the broiler chamber so as to be readily accessible through a front access opening for the chamber. The shield structure can also be used to mount the burner and tracks to support and guide a slidable drawer, which facilitates placement of food within and removal of food from the broiling chamber.

The invention also contemplates a novel method of forming an access/cover plate directly from an element having a flat wall. A continuous cut is made through the element wall to define the cover plate, which is thereby separable from the element. The cover plate, upon being separated from the element, is reoriented, and replaced against the element as reoriented and removably attached thereto.

The inventive method obviates the need for additional tooling to separately produce the cover plate and eliminates scrap.

DETAILED DESCRIPTION OF THE DRAWINGS

FIG. 1 is a perspective view of a free standing gas range having an associated universal frame according to the present invention;

FIG. 2 is a fragmentary, exploded perspective view of the gas range frame employed in FIG. 1 with structure for converting the frame to either a high or low broiler configuration;

DETAILED DESCRIPTION OF THE DRAWINGS

Figure 3:
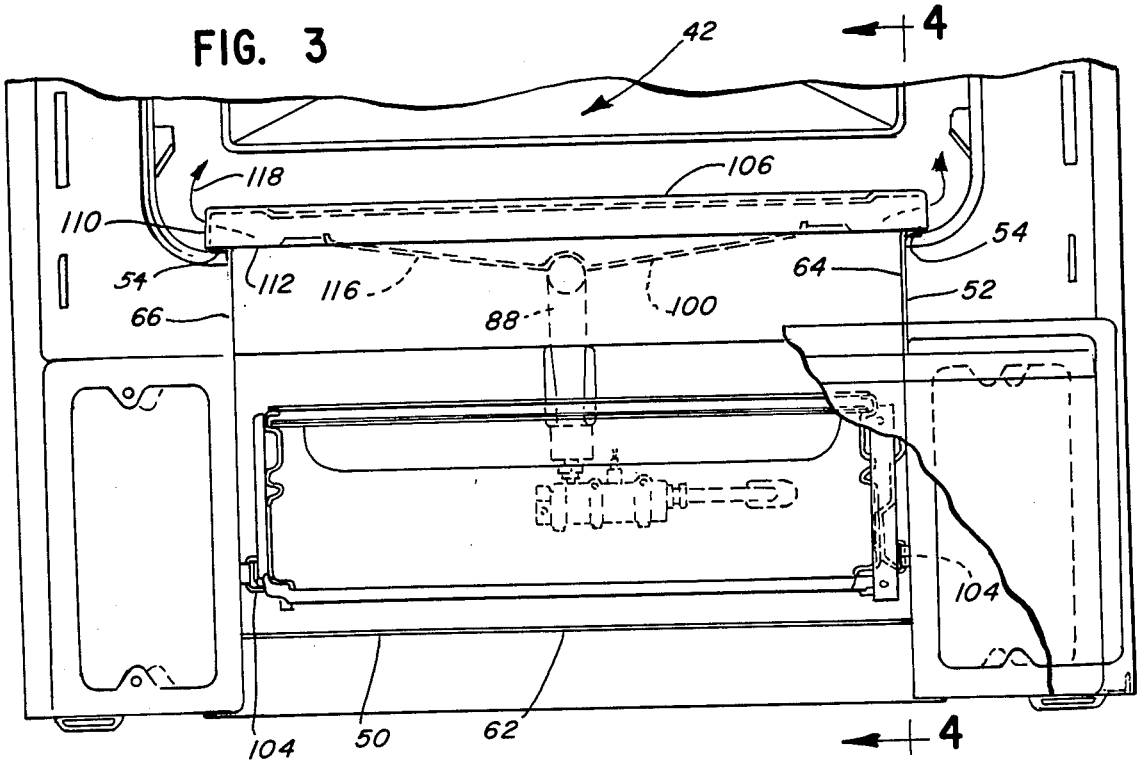
FIG. 3 is a fragmentary, front elevation view of the range frame in a low broiler range configuration.

A free standing gas range, having the present invention incorporated, is shown at 10 in FIG. 1. The range 10 comprises a frame 12 (FIG. 2) defining a main oven compartment at 14 and a lower compartment 16, which is usable selectively, depending upon whether a high broiler configuration or low broiler configuration is desired, as a broiling chamber and a storage compartment. In FIG. 1, the lower compartment is shown as a broiling chamber i.e. a low broiler configuration.

A flat upper support 18 on the range carries four individually controlled top burners 20. The burners 20 and burner(s) (not shown in FIG. 1) in the compartments 14, 16 are individually controlled by knobs 22 on a console 24 at the front of the range. The frame sides are covered by a cabinet 26 which extends over an accessory panel 27 at the rear portion of the range.

Access is gained to the main oven compartment 14 through an opening 28 that is selectively, sealingly closed by a hinged door 30. Access is gained to the lower compartment 16 through an opening 31. A drawer 32 is mounted slidably for movement in a fore and aft direction in and out of the compartment 16. The drawer has a flat support surface 34 for a broiler pan 36 and an associated front panel 38 that seals the opening 31 when the drawer is closed.

Figure 4:
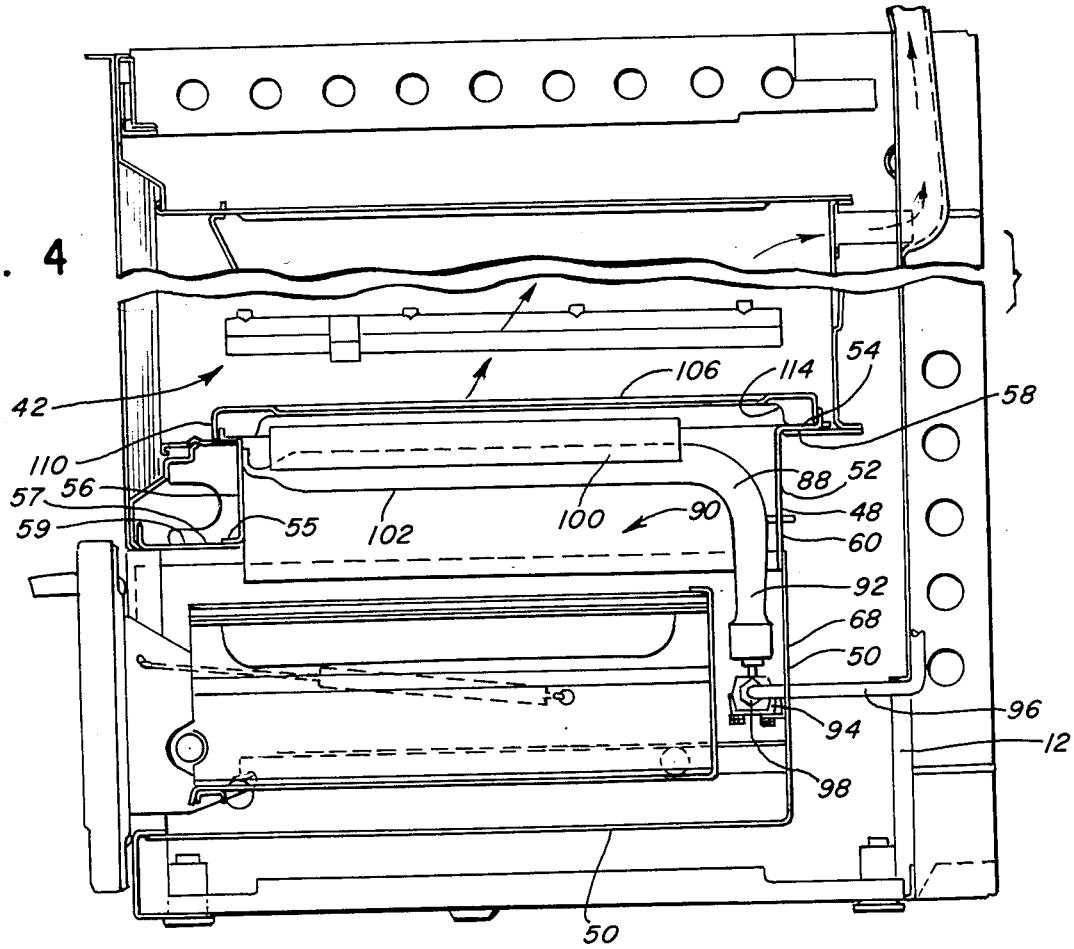
FIG. 4 is fragmentary, sectional view of the range along line 4—4 of FIG. 3.

The inventive structure will first be described with respect to FIGS. 2–4 in a low broiler configuration. The frame 12 has a housing 40 with a wall surface 41 bounding a cooking space 42. The housing has an integral wall 44 which divides the cooking space 42 into the main oven 14 and lower compartment 16. The wall 44 has a rectangular opening 46 therethrough to establish communication between the main oven 14 and compartment 16.

A shield structure, comprising a collar 48 and cooperating bottom shield portion 50, is assembled to the frame. The collar has a rectangular body 52 with an upper, outturned peripheral flange 54. The body dimensions are matched to the opening 46 so that upon directing the collar downwardly through opening 46 from the main oven compartment, the flange 54 overlies the wall 44 and thereby supports the collar in the opening. A flap 55 is bent out of the front wall 56 of the collar 52 and, with the underside 58 of the flange 54 facially overlying the wall 44, bears on the upper surface 57 of a separator 59 on the frame 12.

The collar 52 has an unsupported, depending skirt 60 about three sides thereof. The bottom shield portion 50, which cooperates with the collar 48, is introduced to the lower compartment 16 before the collar is directed fully downwardly. The bottom shield portion 50 has a bottom wall 62 with integral spaced side walls 64, 66 and a rear wall 68 extending upwardly from the bottom wall 62. The collar 48 and bottom shield portion 50 are preferably made from a sheet metal material that is capable of withstanding heat given off by a conventional type burner. The collar skirt 60 and shield portion 50 are dimensioned so that they fit, one within the other, in vertically overlapping relationship. In the disclosed embodiment, the walls 64, 66, 68 on the shield portion 50 reside outside of and closely against wall surfaces 70, 72, 74, respectively, on the collar 48. Self tapping screws 76 are directed through the overlapping portions of the shield portion 50 and collar skirt to secure the connection therebetween.

The front edge 78 of the bottom wall 62 of the shield portion 50 is supported on a rearwardly opening, channel-shaped bracket 80. The ends of bracket 80 are connected to laterally spaced mounting frames 82, 84, which are in turn secured to the frame 12 at the front portion 86 of the compartment 16. To further secure the attachment of the collar 48 and shield portion 50 to the frame 12, a plurality of self tapping screws 79 are directed through the flange 54 on the collar 48 into the dividing wall 44.

A burner 88 is mounted within a broiling chamber 90, bounded cooperatively by the collar 48 and shield portion 50 so that flame producing gas jets (not shown) on the burner 88 reside at the opening 46 so that both the main oven compartment 14 and lower compartment 16 are directly exposed to the burner flame. The burner, which has an L-shaped configuration, has a vertical leg 92 borne by a bracket 94 on the rear wall 68 of the shield portion 50. A gas inlet line 96 is directed through the wall 68 and connects to a control valve 98 for the burner. The control valve 98 rests on the bracket 94 and directly supports the burner leg 92. A conventional flame spreader 100 has a curved central portion 101 in which a horizontal leg 102 on the burner 88 nests to support the flame spreader 100.

The side walls 64, 66 of the shield portion 50 each carry a track 104 for supporting and guiding fore and aft movement of the drawer 32. Upon the drawer 32 being withdrawn, one can easily gain access to the control valve 98 for the burner 88 by reason of its location within the broiling chamber 90.

A removable cover panel 106, having a flat horizontally extending wall 108, is disposed over the opening 46. The wall 108 has a depending, peripheral wall surface 110 with a bottom edge 112 that bears against the dividing wall 44 and maintains the wall 108 spaced slightly above the dividing wall 44. The wall structure 110 has elongate cut outs 114 at opposite sides. Combustion products from the burner are guided along the underside 116 of the flame spreader and directed through the apertures 114 in the direction of arrows 118 into the main oven compartment 14. The panel wall 108 is reinforced by upturned tabs 120 integral with and bent out of the flange 54 on the collar 48, which tabs bear on the underside of the wall 108.

Figure 5:
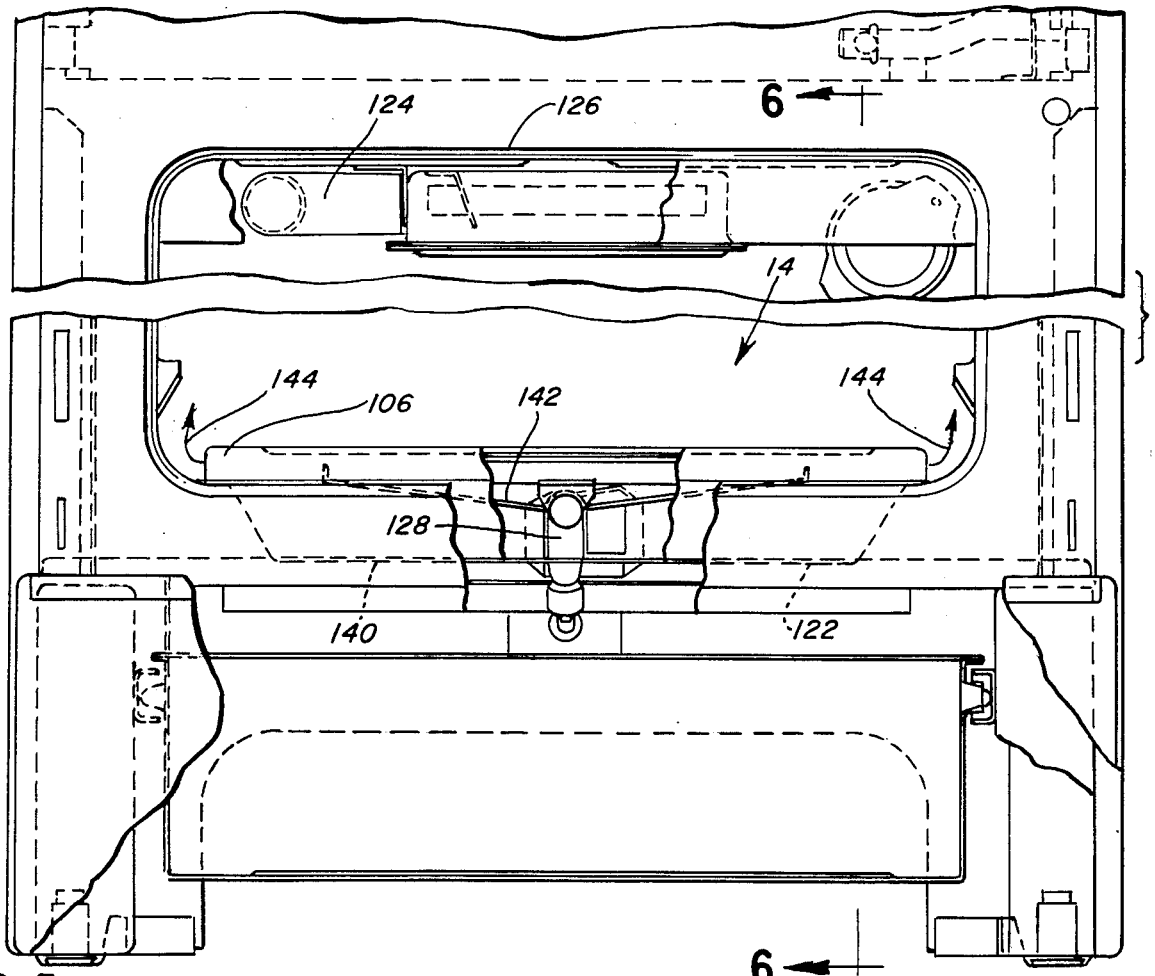
FIG. 5 is a fragmentary, elevation view of the range frame in a high broiler configuration.
Figure 6:
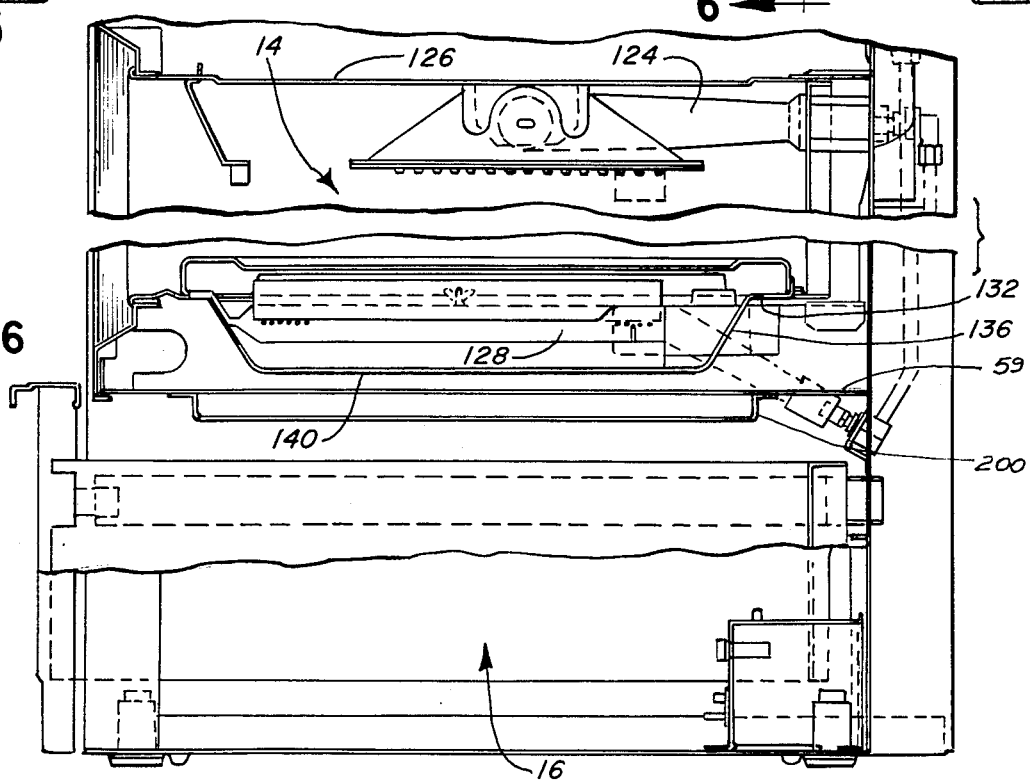
FIG. 6 is a fragmentary, sectional view of the range along line 6—6 of FIG. 5.

The inventive frame structure will now be described in a high broiler configuration, with specific reference to FIGS. 2, 5 and 6. The configuration of the frame 12 in FIGS. 5 and 6 is identical to that in FIGS. 3 and 4, wherein the low broiler configuration is depicted. However, in the high broiler configuration, the collar 48 and shield portion 50 are left out. Instead, a burner support pan 122 is mounted on the wall 44 and extends through the opening 46 therein.

The high broiler has a top burner 124 mounted to an upper wall 126 of the frame 12. A lower burner 128 is mounted at the bottom of the main oven compartment in the opening 46. The top burner 124 is used for broiling and the lower burner 128 is used for baking in the main oven compartment. In the top broiler configuration, the compartment 16 is shielded from the bottom burner 128 by the burner support pan 122 in cooperation with separator 59 and a shield 200 so that the compartment 16 can be used for storage.

The burner support pan 122 comprises a concave, upwardly opening body 130, with two aligned rows of apertures 133 providing air holes for combustion extending therethrough, and having a peripheral, outturned flange 132. The body 130 is assembled from the main oven compartment through the dividing wall opening 46 to situate the underside 134 of the flange 132 facially against the dividing wall 44. The back wall 136 of the pan 122 has a cut out 138 to accommodate the burner 128.

With the pan in place, the compartment 16 is effectively shielded from the burner principally by the bototm wall 140 of the pan 122 along with separator 59 and shield 200. The burner 128 has an associated flame spreader 142 as in the structure in FIGS. 3 and 4 in cooperative relationship with the cover panel 106 to direct combustion products in the direction of arrows 144 from the lower compartment 16 into the cooking space 42.

It can be seen that with the universal frame 12, according to the invention, one can selectively insert shield structure, comprising the collar 48 and bottom shield portion 50, and the burner support pan 122, depending upon whether a high broiler or low broiler configuration is desired.

Another aspect of the disclosed home appliance invention relates to the formation of an access cover from the mounting frame members 82, 84, as shown in FIG. 2. The mounting members 82, 84 are substantially the same and, for illustration, discussion will be limited to one of the members 82. The member 82 is formed so as to define a forwardly facing, flat wall 136 with a peripheral, turned flange 148. A cover plate 150 is cut directly from the wall 146 in substantially a rectangular configuration. Two notches 152, 154 are cut out of the plate so that tabs 160, 162 are defined on and remain integrally attached to the frame member 82 with the cover plate removed. The notches are cut so as not to be symmetrical about a vertical line centered between the edges 156, 158 of the opening from the cut out cover plate 150.

The cover plate is reassembled by reorienting the plate in the direction of arrows 160, i.e. through rotation of 180°, and replacing the cover over the frame opening, so that the notches 160, 162 are misaligned with the tabs 156, 160. Accordingly, the tabs each abut a solid portion of the plate and can be secured thereto as by screws 163.

With the described structure, one can simply cut the cover plate out and, upon reorienting the cover plate, reattach the cover plate to the member from which it was cut. There is no waste material. The cover plate 150 is cut out of each frame member 82, 84 to afford an access opening at the front of the range.

What is claimed is:

1. An improved range frame of the type having a housing with an internal wall surface defining a cooking space, the improvement comprising:

a wall within said cooking space dividing the space into a first, main oven compartment and a second compartment, said dividing wall having an opening therethrough for establishing communication between said compartments;

a pan;

a gas burner;

means for mounting the gas burner in one of said compartments adjacent said dividing wall opening with the gas burner exposed to both compartments; and means for selectively mounting the pan to the housing to shield said second compartment from the gas burner, whereby said frame can be used selectively (a) as part of a high broiler configuration with said pan mounted to the housing permitting said second compartment to be used as a storage compartment, and (b) as part of a low broiler configuration without said pan permitting said second compartment to be exposed to the heating element for broiling of food therein.

2. The improved range frame according to claim 1 including a gas burner shield structure and means for selectively mounting the shield structure on the housing within the cooking space to define a broiling chamber in the second compartment.

3. The improved range frame according to claim 1 wherein said pan comprises a body with a concave portion within which the burner is situated and a peripheral outturned flange extending from the body for resting on the dividing wall to mount the pan on the housing.

4. The improved range frame according to claim 2 wherein said gas burner has an associated gas control valve and means to mount the gas control valve within the broiling chamber.

5. The improved range frame according to claim 2 wherein said shield structure has an associated outturned flange for resting on the dividing wall to mount the shield structure on the housing.

6. The improved gas range frame according to claim 2 wherein the means mounting the gas burner mount the gas burner on the gas burner shield structure.

7. The improved gas range frame according to claim 2 including a broiler drawer and wherein combination guide and support means are provided for said broiler drawer on the shield structure.

8. An improved range comprising:

a frame having an inside surface defining a cooking space and a dividing wall within said space separating said cooking space into a first, main oven compartment and a second compartment, said dividing wall having an opening therethrough for establishing communication between the compartments;

a gas burner;

means for mounting the bas burner in one of the compartments adjacent the dividing wall opening so that the gas burner is exposed to both compartments;

means for selectively attaching wall means to said frame to shield said second compartment from the gas burner; and means for selectively mounting a shield structure to the frame within the cooking space to define a broiling space below and directly exposed to the gas burner.

9. The improved range according to claim 8 wherein the dividing wall is integral with the inside wall surface.

10. An improved range comprising:

a frame having an inside surface defining a cooking space and a dividing wall within said space separating said cooking space into a first, main oven compartment and a second compartment, said dividing wall having an opening therethrough for establishing communication between the compartments;

a gas burner;

means for mounting the gas burner in one of the compartments adjacent the dividing wall opening so that the gas burner is exposed to both compartments;

means for selectively attaching wall means to said frame to shield said second compartment from the gas burner; and a burner shield structure comprising a collar that extends through the opening in the dividing wall and a bottom shield portion for connection to the collar, said collar and shield structure cooperatively protecting the frame surface with the second compartment exposed to the burner.

11. An improved range frame of the type having a housing with an internal wall surface defining a cooking space having a top and bottom, the improvement comprising:

a gas burner;

means for mounting the gas burner within said cooking space between the top and bottom thereof;

at least a portion of the space above said gas burner being a baking region and at least a portion of the space below said gas burner being a broiling region;

means for selectively mounting wall means to the housing to shield the broiling region from the gas burner to permit the broiling region to be used for storage; and means for selectively mounting a shield structure to the housing within the cooking space to define a broiling space below and directly exposed to the gas burner.

12. The improved range frame according to claim 11 in combination with wall means to shield the broiling region from said gas burner.

13. An improved range frame of the type having a housing with an internal wall surface defining a cooking space having a top and bottom, the improvement comprising:

a gas burner;

means for mounting the gas burner within said cooking space between the top and bottom thereof, at least a portion of the space above said gas burner being a baking region and at least a portion of the space below said gas burner being a broiling region;

means for selectively mounting wall means to the housing to shield the broiling region from the gas burner to permit the broiling region to be used for storage;

a gas burner shield structure; and means to attach the gas burner shield structure to the housing to define a broiling chamber, said gas burner shield structure protecting the housing wall surface from heat given off by the gas burner with the broiling compartment unshielded by any wall means.

14. The improved gas range frame according to claim 13 wherein said gas burner has an associated gas control valve and means mount the gas control valve within the broiling chamber.

* * * * *